US011414819B2

(12) United States Patent
Stetson

(10) Patent No.: US 11,414,819 B2
(45) Date of Patent: Aug. 16, 2022

(54) PAVER STONE DECK DRAIN

(71) Applicant: Stetson Development, Inc., Canyon Lake, CA (US)

(72) Inventor: Michael A. Stetson, Canyon Lake, CA (US)

(73) Assignee: Stetson Development, Inc., Canyon Lake, CA (US)

( * ) Notice: Subject to any disclaimer, the term of this patent is extended or adjusted under 35 U.S.C. 154(b) by 302 days.

(21) Appl. No.: 16/423,734

(22) Filed: May 28, 2019

(65) Prior Publication Data

US 2020/0378073 A1 Dec. 3, 2020

(51) Int. Cl.
*E01C 11/00* (2006.01)
*E01C 11/22* (2006.01)

(52) U.S. Cl.
CPC ..... *E01C 11/227* (2013.01); *E01C 2201/20* (2013.01)

(58) Field of Classification Search
CPC ..... E01C 11/227; E01C 2201/20
See application file for complete search history.

(56) References Cited

U.S. PATENT DOCUMENTS 1,111 A * 3/1839 Elliott ..... A01F 12/10 460/78
1,773,417 A * 8/1930 Whitacre ..... C02F 3/10 210/293
5,323,575 A * 6/1994 Yeh ..... E04F 21/1844 52/177
5,363,614 A * 11/1994 Faulkner ..... B26D 3/008 52/262
6,171,015 B1 * 1/2001 Barth ..... E01C 5/001 404/34
6,393,771 B1 5/2002 Stetson
7,344,334 B2 * 3/2008 Thorkelson ..... E01C 5/18 404/28
7,571,572 B2 * 8/2009 Moller, Jr. ..... E01C 5/20 404/41
7,862,729 B2 1/2011 Stetson
7,918,059 B2 * 4/2011 Repasky ..... E04F 15/0247 52/263

(Continued)

FOREIGN PATENT DOCUMENTS

CA 2968109 A1 * 11/2018 ..... E01C 11/16
DE 202014106285 U1 * 6/2015 ..... E01C 9/004
EP 1857592 A1 * 11/2007 ..... E03F 3/046

*Primary Examiner* — Thomas B Will
*Assistant Examiner* — Katherine J Chu
(74) *Attorney, Agent, or Firm* — Stetina Brunda Garred & Brucker

(57) ABSTRACT

A drain is provided which may be used in a surface including a paver stone. The drain includes a body having an upper wall and a cavity extending from the upper wall. The body further includes a drain opening in fluid communication with the cavity. The body additionally includes a plurality of support members. Each support member at least partially extends into the cavity and includes a support surface, with the support surfaces of the plurality of support members being configured to collectively support a paver stone placed thereon. The drain additionally includes a plurality of retainers selectively engageable with the body to collectively define a paver zone sized to receive the paver stone. The body includes a drainage pathway from a location outside of the paver zone, through the cavity and to the drain opening.

8 Claims, 4 Drawing Sheets

(56) References Cited

U.S. PATENT DOCUMENTS

| | | | | |
|---|---|---|---|---|
| 8,240,946 | B2 * | 8/2012 | Applefield | E03F 3/046 404/4 |
| 8,282,310 | B2 * | 10/2012 | White | E01C 3/06 404/18 |
| 9,303,365 | B2 * | 4/2016 | Gooden | E01C 5/001 |
| 9,528,240 | B2 * | 12/2016 | Humphries | E01C 13/083 |
| 9,670,624 | B1 * | 6/2017 | Stiles | E01C 11/225 |
| 10,094,073 | B2 * | 10/2018 | Barth | E01C 3/006 |
| 10,240,332 | B1 | 3/2019 | Stetson | |
| 10,767,319 | B2 * | 9/2020 | Fraser | E01C 5/00 |
| 10,870,977 | B2 * | 12/2020 | Meyers | E03F 5/041 |
| 10,934,700 | B2 * | 3/2021 | Meyers | E03F 5/0408 |
| 10,947,739 | B2 * | 3/2021 | Busby | E04F 15/02464 |
| 11,085,193 | B2 * | 8/2021 | Cataldi | E04F 15/02452 |
| 2006/0159520 | A1 * | 7/2006 | Charon | H02G 9/04 405/118 |
| 2008/0271232 | A1 * | 11/2008 | Self | E03C 1/264 4/292 |
| 2009/0094918 | A1 * | 4/2009 | Murphy | E01C 13/08 52/387 |
| 2010/0320130 | A1 * | 12/2010 | Meyers | E03F 5/04 210/164 |
| 2014/0366461 | A1 * | 12/2014 | Busby | E04F 15/02044 52/126.6 |
| 2018/0171618 | A1 * | 6/2018 | Erlebach | E03F 5/0407 |
| 2019/0106874 | A1 * | 4/2019 | Brill | E03F 3/046 |
| 2019/0242107 | A1 * | 8/2019 | McLeod | E03F 5/0408 |
| 2019/0330809 | A1 * | 10/2019 | Cuellar | E01C 11/225 |
| 2020/0157790 | A1 * | 5/2020 | English | E03C 1/22 |
| 2021/0032883 | A1 * | 2/2021 | Byer | E04F 13/02 |
| 2021/0374066 | A1 * | 12/2021 | Shah | G11C 16/26 |

* cited by examiner

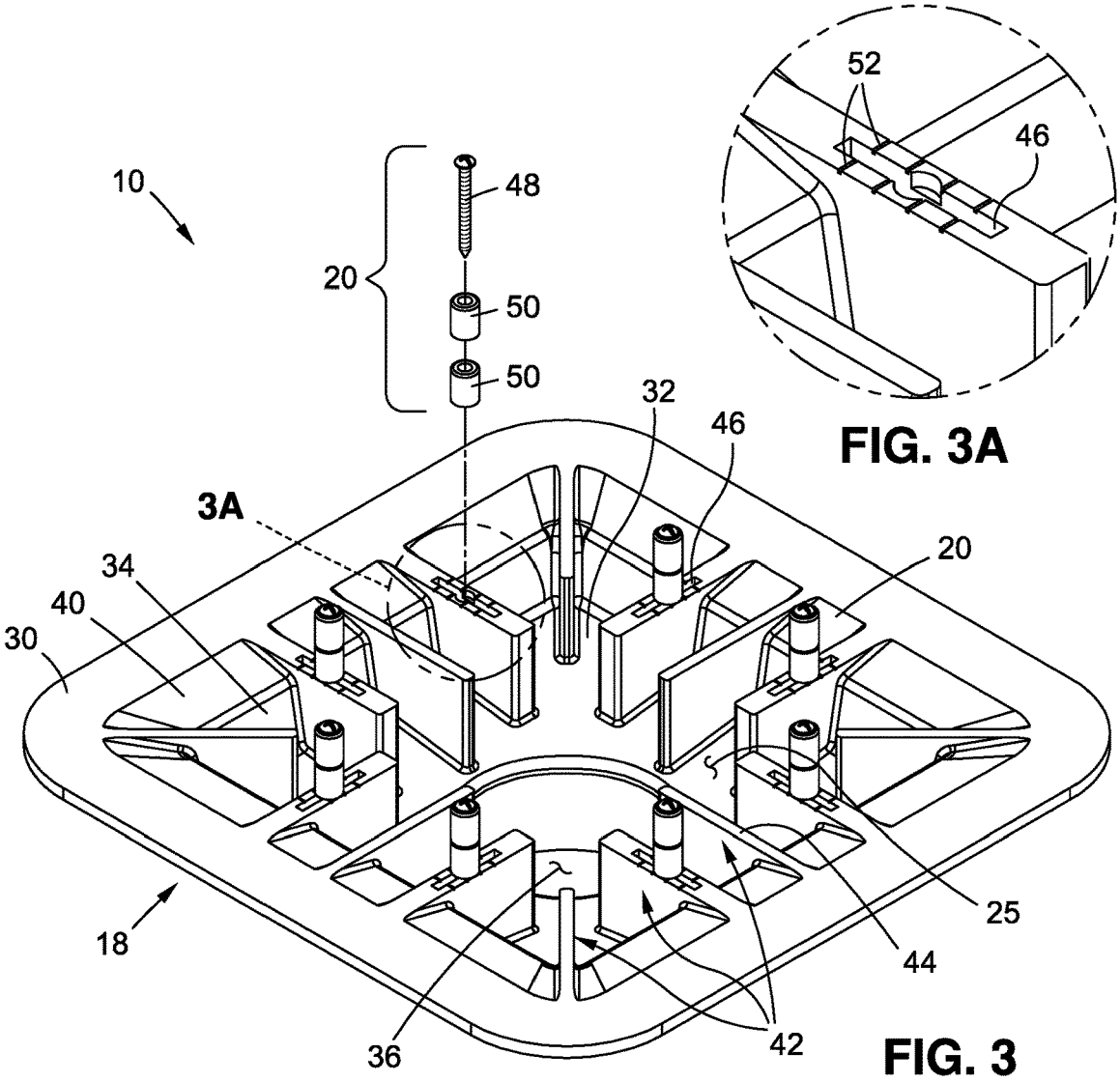
FIG. 3A
FIG. 3
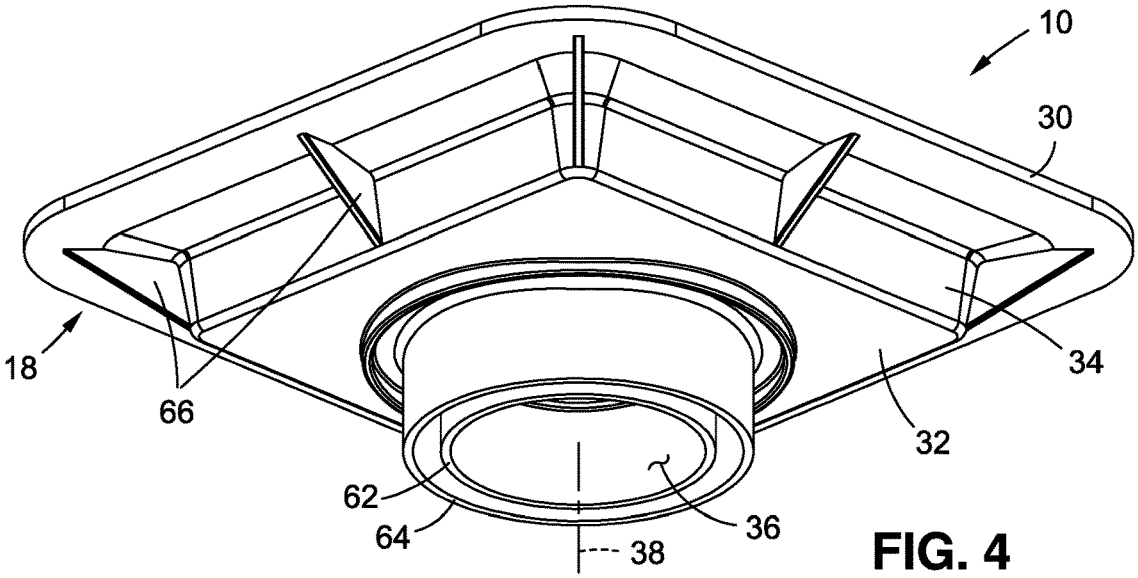
FIG. 4

PAVER STONE DECK DRAIN

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to a drain for use in landscaping applications, and more specifically to a drain that may be incorporated into a surface formed from paver stone.

2. Description of the Related Art

Many residential and commercial buildings include decorative or landscaped surfaces, such as decks, patios, porches, garages, etc. Such surfaces are commonly located outside and exposed to precipitation, or located adjacent a pool, sprinkler, or water feature. Consequently, water and other liquids may accumulate on the surface, which may result in slick, unsafe conditions. Furthermore, if the water is not removed from the surface, the water may cause aesthetic or structural damage. Therefore, many surfaces are oftentimes graded to induce runoff in a predisposed direction. In some cases, the liquid runoff is directed toward a runoff area, which may include vegetation or soil located adjacent at least one side of the landscaped surface. However, in other cases, the particular landscaped surface is situated such that an appropriate runoff area is not available. For example, the surface may be surrounded by four walls, e.g., a courtyard, or the surface may extend between a house and a pool. In either case, the landscaped surface may not be graded to direct the water to an appropriate runoff area. Therefore, many surfaces include a drain which collects the water that accumulates on the surface.

Most drains include plumbing that directs the water into a drainage system. The drain may include a lid on top of the plumbing. In most cases, the lid is flush with the landscaped surface. The cover or lid for current drains are typically not constructed from the same material as the surrounding landscaped surface. Along these lines, many landscaped surfaces are formed from paver stones, whereas the drain cover is commonly constructed out of metal, typically brass. This difference in material has several functional and cosmetic disadvantages. In particular, drain covers constructed from dissimilar materials can be a safety hazard because the cover will generally have a different coefficient of friction compared to the surrounding landscaped surface. For example, most metal drain covers typically include a relatively smooth finish compared to the surface of paver stone. A significant change in surface texture such as this increases the risk of a slip and fall accident as unsuspecting persons step from one surface having a high coefficient of friction to another having a lower coefficient of friction or visa-versa. Moreover, the risk of an accident can be especially great when the cover is wet, as may be the case when children are playing near a swimming pool.

In addition to creating a potential safety hazard, drain covers constructed from dissimilar materials can also be less desirable for cosmetic reasons. In many cases, a large amount of time and money is spent to make the landscaped surface look as aesthetically pleasing as possible. Many of the surfaces are intended to be prominent architectural features. In this setting, it may be more desirable to use a drain cover which matches the visual appearance of the surrounding fabricated layer.

Accordingly, there is a need in the art for a more aesthetically appealing drain cover or drain that is located within a landscaped surface, such as a surface formed from paver stones. Various aspects of the present disclosure address this particular need, as will be discussed in more detail below.

BRIEF SUMMARY

Various aspects of the present disclosure are directed toward a drain configured to be incorporated into a surface formed from paver stones. The drain may be specifically adapted to reside beneath the paver stones and provide a drainage path between adjacent paver stones and into a drain pipe. In this regard, one or more paver stones may act as the lid or cover to the drain, thereby preserving the aesthetics of the landscaped surface.

In accordance with one embodiment of the present disclosure, there is provided a drain including a body having an upper wall and a cavity extending from the upper wall. The body further includes a drain opening in fluid communication with the cavity. The drain additionally comprises a plurality of support members. Each support member at least partially extends into the cavity and includes a support surface, with the support surfaces of the plurality of support members being configured to collectively support a paver stone placed thereon. The drain additionally includes a plurality of retainers selectively engageable with the body to collectively define a paver zone sized to receive the paver stone. The body includes a drainage pathway from a location outside of the paver zone, through the cavity and to the drain opening.

The drain may further include a plurality of slots formed in respective ones of the plurality of support members, with the plurality of retainers being advanceable through respective ones of the plurality of slots. The drain may additionally comprise a plurality of visual indicators formed along a respective one of the plurality of slots. The plurality of retainers may include a screw threadingly engageable with the body as the retainers are advanced through respective ones of the plurality of slots. The plurality of retainers may include a plurality of height adjustment collars, with each screw being insertable through at least one of the plurality of height adjustment collars when engaged with the body.

The body may additionally include a lower wall, with the drain opening being formed in the lower wall. A first collar may extend from the lower wall and may circumnavigate the drain opening. The body may additionally include a second collar extending from the lower wall and circumnavigating the first collar.

The plurality of support members may be co-planar with each other.

According to another implementation, there is provided a drain for use with a paver stone. The drain includes a paver support surface configured to be engageable with the paver stone. A plurality of retainers are adjustably coupled to the paver support surface and extend from the paver support surface to define a paver zone over the paver support surface that is sizable to be complementary to the paver stone. The drain additionally includes a lower wall spaced from the paver support surface, with the lower wall having an opening formed therein. A drainage path extends from the paver support surface to the opening in the lower wall.

The plurality of retainers may be translatably coupled to the paver support surface.

The drain may include a plurality of supports spaced from each other and collectively defining the paver support surface. The plurality of supports may extend from the lower wall.

According to another embodiment, there is provided a method of installing a drain in a surface including a paver stone. The method includes the steps of placing a drain on a foundation, with the drain including a plurality retainers adjustably coupled to a body; adjusting the plurality of retainers to be complementary in size to the paver stone; and placing the paver stone within a paver zone collectively defined by the plurality of retainers.

The method may additionally include the step of adjusting a height of the plurality of retainers relative to the paver support surface.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which:

FIG. 3 is an upper perspective view of the drain;

FIG. 3A is an enlargement of a support member including a slot formed therein;

FIG. 4 is a lower perspective view of the drain;

Common reference numerals are used throughout the drawings and the detailed description to indicate the same elements.

DETAILED DESCRIPTION

Figure 1:
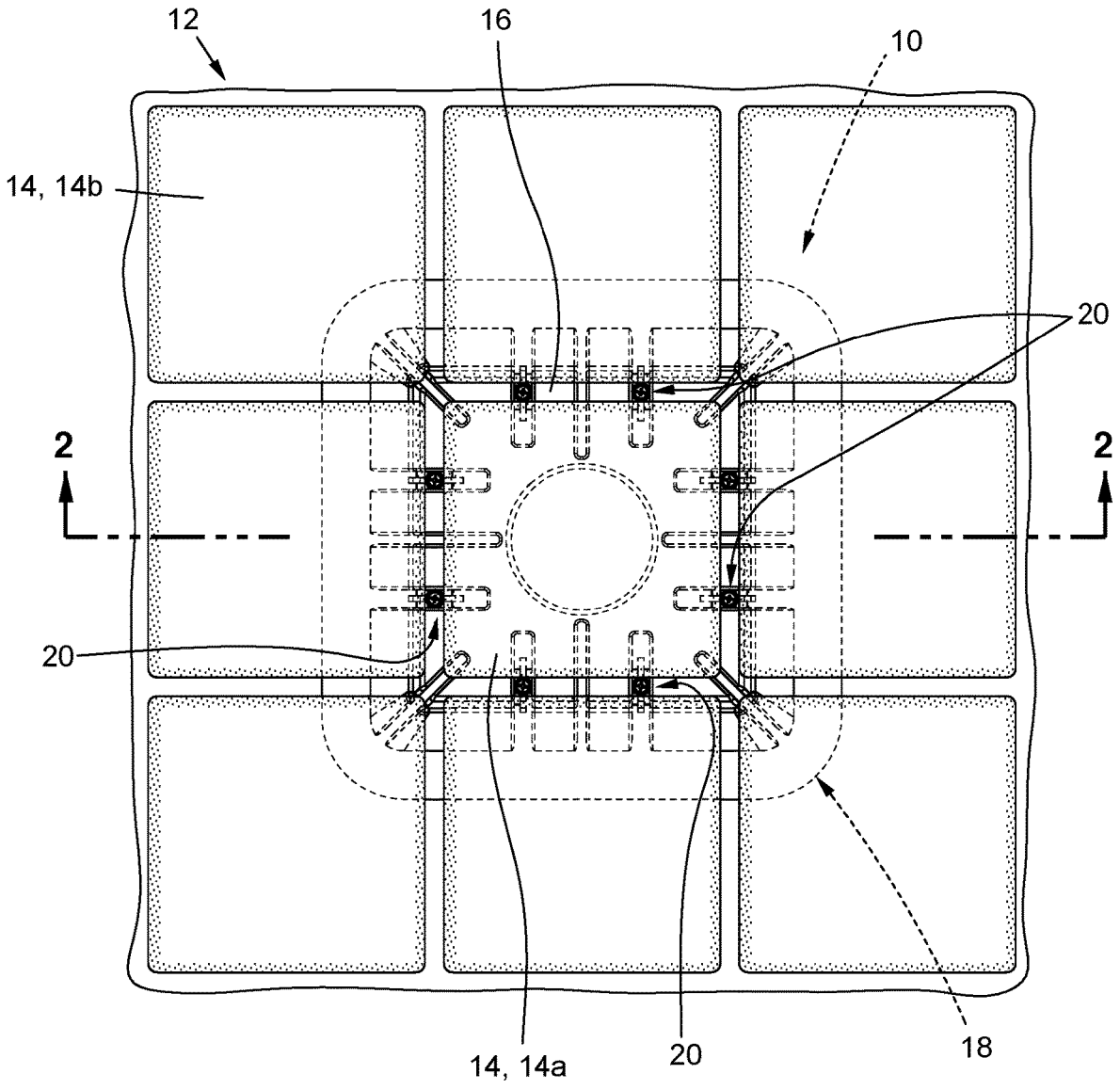
FIG. 1 is a top view of a drain installed in a landscaped surface formed from a plurality of paver stones.

Referring now to the drawings, wherein the showings are for purposes of illustrating preferred aspects of the present disclosure, and are not for purposes of limiting the same, there is depicted a drain 10 for use in a landscaped surface 12 formed of paver stones 14. The drain 10 is configured to reside beneath an upper, exposed surface of the paver stones 14 to remain substantially hidden or concealed from view. Furthermore, the drain 10 is configured to allow for a paver stone 14*a* to be placed on top of the drain 10 to minimize the disruption of the layout of paver stones 14 in the landscaped surface 12. The drain 10 may create a small gap 16 around the paver stone 14*a* placed thereon to create a drainage pathway through the landscaped surface 12. The drain 10 may include a cavity under the paver stone 14*a*, in communication with the small gap 16, with the cavity being in communication with an underlying drain pipe. Accordingly, the drain 10 may provide an aesthetically pleasing drain 10 in a landscaped surface 12 formed from paver stone 14.

FIG. 1 is a top view of the landscaped surface 12 including paver stones 14 arranged in rows and columns. The paver stones 14 include a plurality of peripheral paver stones 14*b* disposed about central paver stone 14*a*. The drain 10 includes a body 18, a substantial portion of which is depicted in phantom in FIG. 1 to represent its location as laying beneath the plurality of paver stones 14. A plurality of retainers 20 are adjustably connected to the body 18 and collectively define a paver zone sized to receive the central paver 14*a*, such that the central paver 14*a* is supported over the body 18. The body 18 may also be configured to at least partially support the peripheral paver stones 14*b*, which may be placed in abutment with the retainers 20. As can be seen from FIG. 1, the drain 10 may be installed such that most of the drain 10 (e.g., the drain body 18) is concealed beneath the paver stones 14. Furthermore, the retainers 20 may be sized to recessed below the upper wall of the paver stones 14, while also being positioned around the central paver stone 14*a* so as to keep the central paver stone 14*a* in a desired position and restrict sliding of the central paver stone 14*a* over the drain body 18. The retainers 20 also create space between the central paver 14*a* and the peripheral pavers 14*b* to create the gap 16 for drainage.

Figure 2:
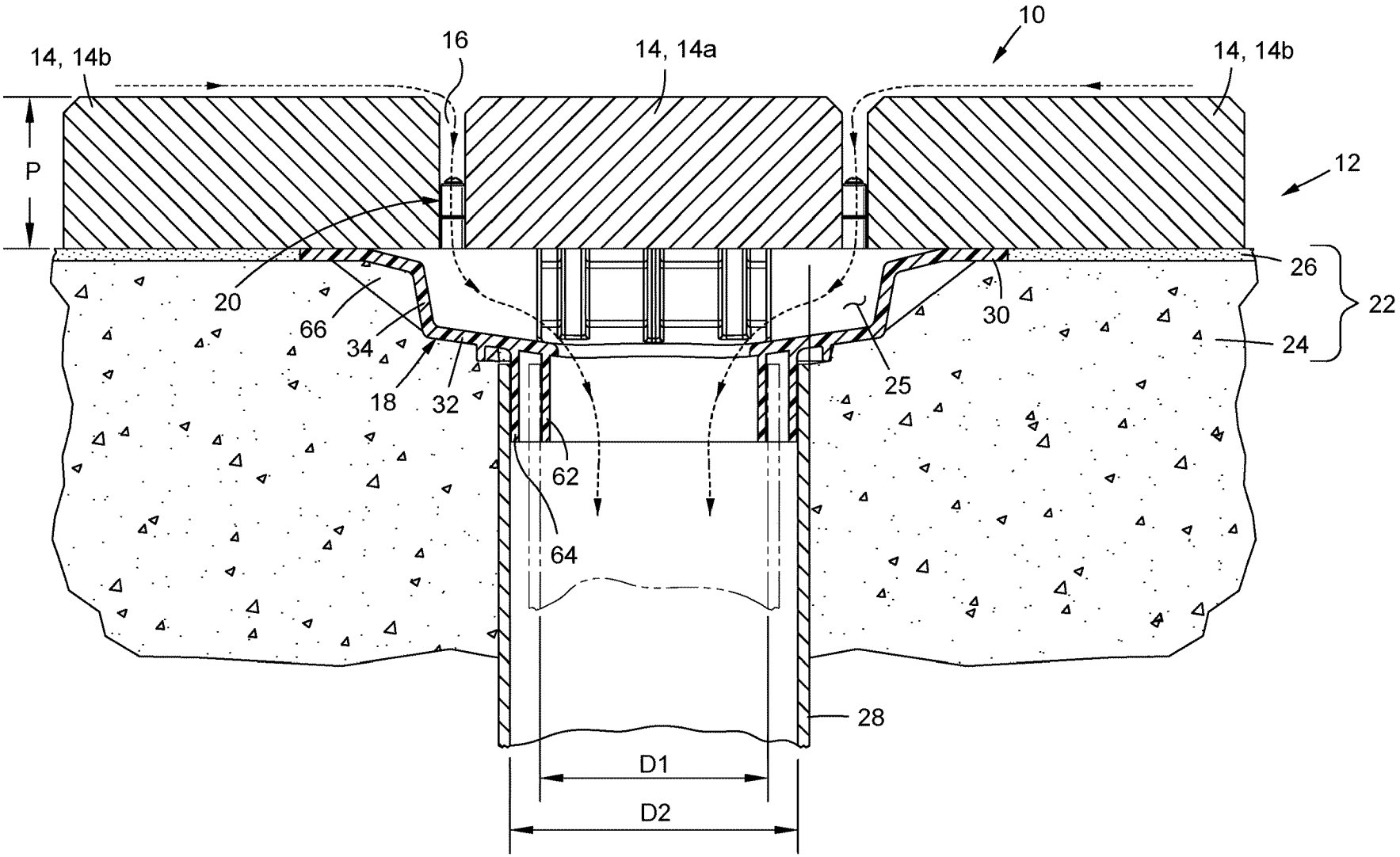
FIG. 2 is a cross sectional view of the drain of FIG. 1.
Figure 5:
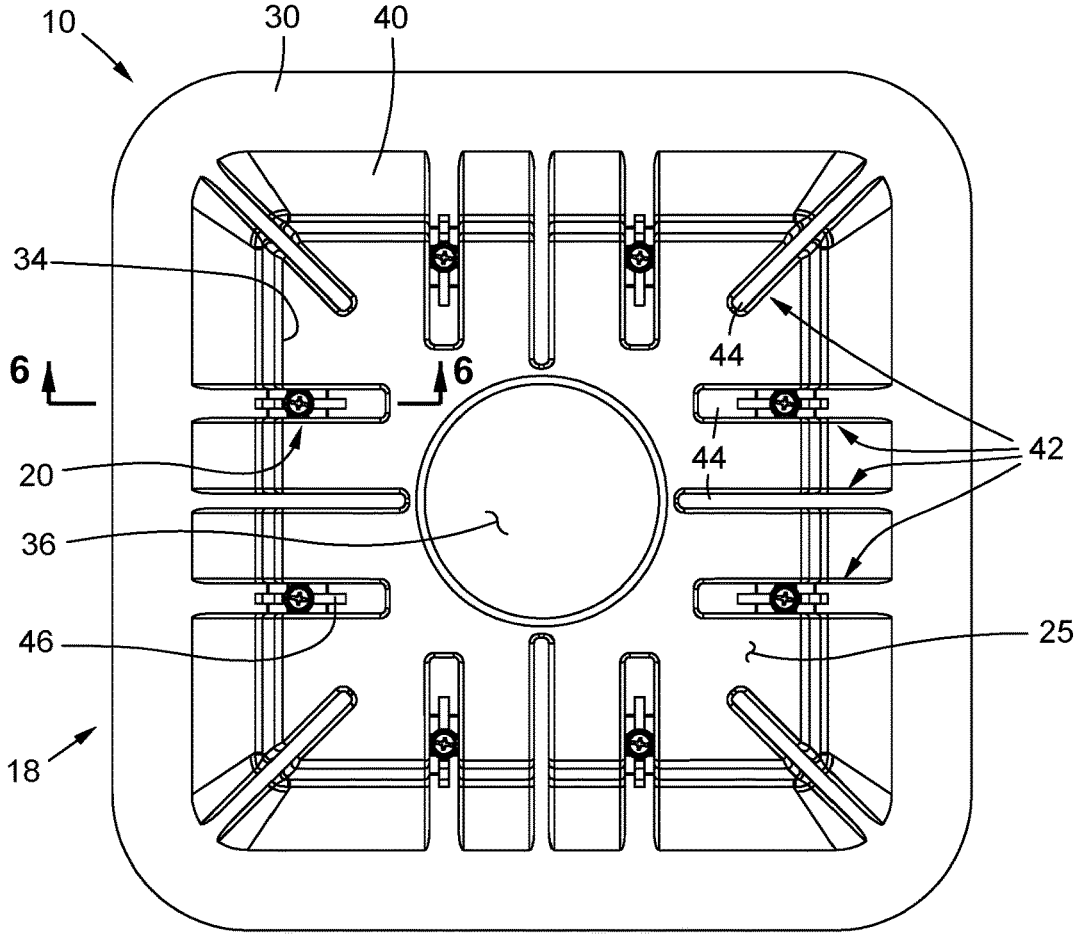
FIG. 5 is a top view of the drain.
Figure 6:
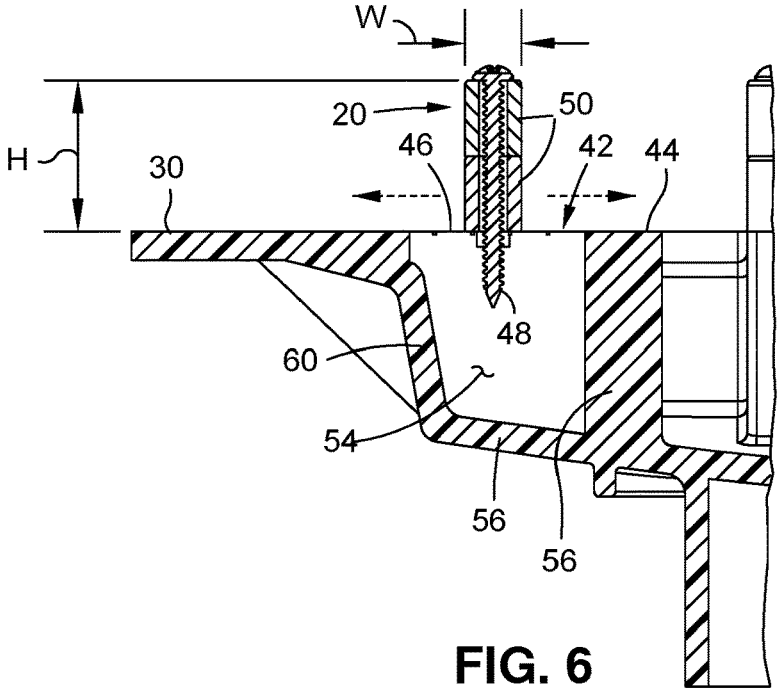
FIG. 6 is a partial cross sectional view of the drain depicting a screw being received in a slot cavity formed in a support member of the drain body.

FIG. 2 is a cross sectional view of the landscaped surface 12 and the drain 10 shown in FIG. 1. The landscaped surface 12 may include a foundation 22 including a subgrade 24 (e.g., soil) and fill sand 26 poured on top of the subgrade 24. The body 18 of the drain 10 may be positioned so as to extend through the fill sand 26 and into the subgrade 24 to stabilize the body 18. The paver stones 14 may be placed on top of the fill sand 26 and over the body 18 of the drain 10. The dashed arrows in FIG. 2 represent possible flow of liquid draining across the upper surface of the paver stones 14, through the gap 16 in the paver stones 14, through a cavity 25 underneath the central paver stone 14*a*, and then into a drain pipe 28.

Referring now to FIGS. 3-6, according to one embodiment, the body 18 includes an upper wall 30, a lower wall 32 and a sidewall 34 extending between the upper wall 30 and the lower wall 32. The upper wall 30, sidewall 34 and lower wall 32 may collectively define the cavity 25. The lower wall 32 may include a drain opening 36 formed therein and in communication with the cavity 25. The drain opening 36 may be spaced from the sidewall 34 and extend around a central axis 38. The upper wall 30 may extend away from the sidewall 34 to form a peripheral flange. A sloped transition surface 40 may extend between the upper wall 30 and the sidewall 34, to promote fluid flow from the upper wall 30 and into the cavity 25.

The body 18 additionally includes a plurality of support members 42 extending from the upper wall 30 and the sidewall 34 into the cavity 25. In this regard, each support member 42 may be shaped like a finger or fin and extending from the upper wall 30 and sidewall 34 and terminating at a distal end. Each support member 42 includes a support surface 44, such that the plurality of support surfaces 44 collectively support the central paver stone 14*a* when placed thereon. Along these lines, the support members 42 may be co-planar with each other. The support members 42 may be arranged in generally opposed pairs, with the support members 42 of each pair being arranged on opposite sides of the drain opening 36. Such an arrangement may provide stability and balance to the paver stone 14*a* placed thereon.

The drain 10 may additionally include slots 46 formed in some, if not all, of the support members 42. Each slot 46 may extend through the support surface 44 on the corresponding support member 42 and may be generally linear and allow for selective adjustment of the retainers 20 relative to the body 18, the importance of which will be described in more detail below.

The body 18 may be formed from acrylonitrile butadiene styrene (ABS), polyvinyl chloride (PVC) or other polymer materials known in the art. Furthermore, the body 18 may be formed from a molding procedure, such that the upper wall 30, sidewall 34, lower wall 32 and support members 42 form a unitary, integral structure.

The retainers 20 are engageable with the body 18 to collectively define a paver zone complementary to, and sized to receive, the paver stone 14*a*. According to one embodiment, each retainer 20 includes a screw 48 and one or more height adjustment collars 50, through which the screw 48 is placed. The collar(s) 50 define a height H and a width W associated with each retainer 20. The height H may be adjusted by adding or subtracting the number of height adjustment collars 50 around the screw 48. In particular, the height H may be increased by increasing the number of height adjustment collars 50 disposed about the screw 48. Conversely, the height H may be decreased by reducing the number of height adjustment collars 50 disposed about the screw 48. The height H of each retainer 20 may be adjusted such that the retainers 20 do not extend beyond the upper, exposed surface of the paver stones 14. In this regard, the retainers 20 may remain at a receded position so as not to create a tripping hazard and to minimize the appearance thereof, while at the same time being of sufficient height to collectively retain the paver stone 14*a* in place. The width W may define the size of the gap 16 extending between adjacent paver stones 14*a*, 14*b* and may be ⅛"-½", and more preferably approximately ¼". Of course, the size of the gap 16 may vary without departing from the spirit and scope of the present disclosure.

Each retainer 20 may be secured to the body 18 through threaded engagement between the screw 48 and the body 18. The slots 46 formed in the support members 42 may facilitate threaded engagement between the screw 48 and the body 18. In particular, the tip of the screw 48 may be inserted into the slot 46 to locate the screw 48 in the slot 46. With the tip of the screw 48 advanced into the slot 46, the screw 48 may be selectively positioned within the slot 46 based on the size and configuration of the paver stone 14*a* that is to be placed on the drain 10. The body 18 may include one or more visual indicators 52 positioned along the slot 46 to provide a visual reference point for the user when adjusting the position of the retainers 20 relative to the body 18. For instance, it may be desirable to centrally position the paver stone 14*a* over the body 18, and the visual indicators 52 may aid in achieving central placement thereof. In the exemplary embodiment, the visual indicators 52 include four small notches formed generally perpendicularly to the slot 46 in spaced relation to each other. Although the exemplary embodiment of the visual indicators 52 includes notches, it is contemplated that in other embodiments, the visual indicators 52 may include ribs, protrusions, bumps, nubs, printed matter or any other visual element that may provide a reference point for the user.

Each support member 42 including a slot 46 may also include a recessed cavity 54 (see FIG. 6) in communication with the slot 46. The recessed cavity 54 may be defined by a first wall 56 separating the recessed cavity 54 from the main cavity 25, a lower wall 58, and a second wall 60 opposite the first wall 56. The recessed cavity 54 may be sized to receive the tip of the screw 48 when the screw is connected to the body 18.

Although the foregoing describes the retainers 20 as including a screw 48 and collars 50, with the screw 48 being selectively positionable in a slot 46, it is contemplated that other retainers 20 known in the art may also be used without departing from the spirit and scope of the present disclosure. For instance, the retainers 20 may include a track extending along a corresponding support member 42, with the track being engaged with a slide element. The slide element may be selectively positionable on the track to adjust the position of the retainer relative to the body. Stacking elements may be placed on the slide element to adjust the height of the retainer. It is also contemplated that other retaining elements known in the art may also be used.

Referring now to FIGS. 2 and 4, the drain 10 may include one or more collars 62, 64 which may be configured to facilitate attachment of the drain to the drain pipe 28. A first collar 62 may extend from the lower wall 32 and may circumnavigate the drain opening 36. The first collar 62 may define a first outer diameter D1, and thus, may be configured for use with a drain pipe 28 having an inner diameter substantially equal to D1. The drain 10 may additionally include a second collar 64 extending from the lower wall 32 and circumnavigating the first collar 62. The second collar 64 may define a second outer diameter D2 larger than D1, and thus, may be configured for use with a drain pipe 28 having an inner diameter substantially equal to D2. By including multiple collars 62, 64 on the drain 10, the drain 10 may be used with several drain pipes, and thus, may be universal in nature.

The drain 10 may additionally include a plurality of external fins 66, which may extend outwardly from the sidewall 34 and the upper wall 30 to facilitate anchoring and stabilization of the body 18 within a subgrade 24 during installation of the body 18.

With the basic structure of the drain 10 described above, the following discussion will describe installation and use of the drain 10 according to one embodiment. Prior to installing the drain 10, the foundation 22 may be prepared by forming the subgrade 24, and then placing fill sand 26 on top of the subgrade 24. The foundation 22 may be formed around the drain pipe 28, which may have an end exposed for engagement with the drain 10. Once the foundation 22 is prepared, the drain 10 may be installed. In particular, the body 18 is placed on the foundation 22, with the lower wall 32 and sidewalls 34 extending into the subgrade 24 and the upper wall 30 extending through the fill sand 26. The upper wall 30 may rest on top of the subgrade 24, with the fill sand 26 extending around the upper wall 30, with the upper surface of the upper wall 30 being substantially flush with the upper surface of the fill sand 26. When the body 18 is placed on the foundation, the drain pipe 28 is connected to one of the collars 62, 64, and more specifically, the collar 62, 64 that is complementary in sized to the drain pipe 28. The engagement between the drain pipe 28 and the collar may be a friction fit engagement, although an adhesive or other bonding agent may be used to strengthen the engagement therebetween. The engagement may also be a substantially fluid tight engagement to mitigate fluid leakage through the interface between the collar and the drain pipe 28.

Installation of the drain 10 may also entail installation and adjustment of the retainers 20 on the body 18. The retainers 20 are installed on the body 18 such that the retainers 20 collectively define a paver zone which is complementary in size and shape to the paver stone 14*a*. Accordingly, the paver stone 14*a* may be temporarily placed on the body 16 to identify where the retainers 20 should be placed. When the paver stone 14*a* is temporarily placed on the body 16, the user may use the visual indicators 52 to center the paver stone 14*a* and identify where the retainers 20 need to be placed. Once the location of the retainers 20 has been identified, the paver stone 14*a* may be removed to facilitate connection of the retainers 20 to the body 18.

A desired height H of the retainers 20 may be determined by identifying a paver height P, such that the height H of the retainers 20 is less than the paver height P. The height H may be set by stacking a desired number of collars 50 around each screw 48. The retainers 20 are installed onto the body 18 by inserting the tip of the screw 48 into a corresponding slot 46.

Once the sufficient number of collars 50 are placed on the screw 48, and the screw 48 is in the correct position relative to the body 18, the screw 48 may be rotated to advance the screw 48 into the body 18. Along these lines, the width of the screw threads may be slightly larger than the width of the slot 46, which allows the threads of the screw 48 to engage with the body 18. The screw 48 is tightened until the collars 50 are captured between the head of the screw 48 and the body 18. Once all of the retainers 20 are in place, the paver stone 14*a* may be placed within the paver zone, with the retainers 20 preferably being in abutting contact with the paver stone 14*a*. Thus, the abutment between the paver stone 14*a* and the retainers 20 mitigates unwanted movement of the paver stone 14*a* relative to the body 18, which could otherwise lead to an unstable walking surface and cause unsafe walking conditions.

The retainers 20 also create the gap 16 between the central paver stone 14*a* and the peripheral paver stones 14*b* disposed around the central paver stone 14*a*. The gap 16 provides a drainage pathway into the cavity 25 and then ultimately through the drain opening 36.

Once the drain 10 is installed, and the pavers 14*a*, 14*b* are placed on the drain 10, the drain 10 may be substantially concealed from view, while at the same time, functioning similar to a conventional drain by providing a flow path for liquid away from the landscaped surface. The drain 10 may not require a lid or cover that is formed from a material different from the paver stone 14, but instead, may allow a paver stone 14 to be placed over the drain 10 to maintain aesthetic continuity.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A drain system for use in a surface including a paver stone, the drain system comprising:

a body having:

an upper wall;

a cavity extending from the upper wall;

a drain opening in fluid communication with the cavity; and a plurality of support members, each support member at least partially extending into the cavity and having a support surface, the support surfaces of the plurality of support members being configured to collectively support a paver stone placed thereon;

a paver stone placed directly on the plurality of support members; and a plurality of retainers selectively engageable with the body to collectively define a paver zone sized to receive the paver stone;

the body having a drainage pathway from a location outside of the paver zone, through the cavity and to the drain opening.

2. The drain system recited in claim 1, further comprising a plurality of slots formed in respective ones of the plurality of support members, the plurality of retainers being advanceable through respective ones of the plurality of slots.

3. The drain system recited in claim 2, further comprising a plurality of visual indicators formed along a respective one of the plurality of slots.

4. The drain system recited in claim 2, wherein the plurality of retainers include a screw threadingly engageable with the body as the retainers are advanced through respective ones of the plurality of slots.

5. The drain system recited in claim 4, wherein the plurality of retainers include a plurality of height adjustment collars, each screw being insertable through at least one of the plurality of height adjustment collars when engaged with the body.

6. The drain system recited in claim 1, wherein the body further comprises:

a lower wall, the drain opening being formed in the lower wall; and a first collar extending from the lower wall and circumnavigating the drain opening.

7. The drain system recited in claim 6, wherein the body further comprises a second collar extending from the lower wall and circumnavigating the first collar.

8. The drain system recited in claim 1, wherein the support surfaces of the plurality of support members are co-planar with each other.

* * * * *